US006948920B2

(12) United States Patent
Stoner et al.

(10) Patent No.: US 6,948,920 B2
(45) Date of Patent: Sep. 27, 2005

(54) TOILET BOWL AND TANK DRAINAGE DEVICE

(75) Inventors: Michael A. Stoner, Bozeman, MT (US); Tyler Merica, Bozeman, MT (US)

(73) Assignee: SWS Corporation, Bozeman, MT (US)

( * ) Notice: Subject to any disclaimer, the term of this patent is extended or adjusted under 35 U.S.C. 154(b) by 68 days.

(21) Appl. No.: 10/326,532

(22) Filed: Dec. 19, 2002

(65) Prior Publication Data

US 2003/0178061 A1 Sep. 25, 2003

Related U.S. Application Data

(60) Provisional application No. 60/342,654, filed on Dec. 19, 2001.

(51) Int. Cl.[7] ..... F04B 7/02

(52) U.S. Cl. ..... 417/443; 417/437; 417/234; 417/557; 417/559; 417/569; 417/313; 137/150

(58) Field of Search ..... 417/437, 435, 417/234, 443, 557, 559, 565, 569, 313; 137/150; 4/661

(56) References Cited

U.S. PATENT DOCUMENTS

| | | | | | |
|---|---|---|---|---|---|
| 238,136 | A | | 2/1881 | Manwaring | |
| 862,867 | A | * | 8/1907 | Eggleston | 417/390 |
| 1,783,095 | A | * | 11/1930 | Muirhead et al. | 137/150 |
| 2,640,431 | A | * | 6/1953 | Neal | 137/150 |
| 2,761,833 | A | | 9/1956 | Ward | |
| 2,956,507 | A | | 10/1960 | Hutchinson | |
| 3,158,104 | A | * | 11/1964 | Hutchinson | 210/416.2 |
| 3,407,430 | A | | 10/1968 | Renner | |
| 3,549,015 | A | * | 12/1970 | Willinger | 210/416.2 |
| 4,218,195 | A | * | 8/1980 | Shure | 417/411 |
| 4,301,826 | A | | 11/1981 | Beckerer | |
| 4,584,733 | A | | 4/1986 | Tietge et al. | |
| 5,095,571 | A | | 3/1992 | Sargent | |
| 5,135,647 | A | * | 8/1992 | Childers | 210/136 |
| 5,388,966 | A | * | 2/1995 | Bley | 417/234 |
| 6,019,891 | A | | 2/2000 | Stoner | |

* cited by examiner

*Primary Examiner*—Cheryl Tyler
*Assistant Examiner*—Emmanuel Sayoc
(74) *Attorney, Agent, or Firm*—Holme Roberts & Owen LLP

(57) ABSTRACT

A hand held an portable pump has a housing with an inlet on the bottom and an outlet on its side. A central tube extends up from the housing and has a bulb attached at its end. An inlet gate is positioned proximate the inlet to operate between a closed position in which the flow of liquid there through is inhibited and an open position in which liquid may flow through the inlet. The outlet has an outlet gate that is positioned to inhibit the flow of liquid into the housing in its closed position and to permit the flow of liquid out of the housing and into a discharge tube in the open position. The bulb is operated between an at rest position and a deflected or compressed position to urge fluid into and out of the bulb and in turn draw liquid through the inlet into the housing and to urge the liquid out of the outlet and into the discharge tube.

13 Claims, 8 Drawing Sheets

TOILET BOWL AND TANK DRAINAGE DEVICE

This application claims the benefit of U.S. Provisional Application No. 60/342,654, filed Dec. 19, 2001.

BACKGROUND OF THE INVENTION

1. Field of the Invention

The present invention relates to a portable, hand-operated drainage device for use in evacuating water from a water receptacle such as the bowl and tank of a toilet.

2. State of the Art

Small, hand-held devices for draining or otherwise removing or transporting liquids from a first location to a second location are known. For example, U.S. Pat. No. 238,136 (Manwaring) describes and illustrates a hand-operated siphon pump having a pair of check-valves positioned inside a main tube. A hand-operated vacuum lift pump and siphon for handling liquids is similarly disclosed in U.S. Pat. No. 4,301,826 (Beckerer). Unlike the Manwaring and Becker pumps, U.S. Pat. No. 2,640,431 (Neal) discloses a device that is intended for use as, among other things, a toilet bowl siphon pump. U.S. Pat. No. 5,388,966 (Bley) also discloses a pump that may be used for draining a toilet bowl. The devices described in the above noted patents show both hand and power operated pumps that may be used to transport water, for example, from one tank to another or from the bilge of a boat to the surrounding water. The Neal and Bley pumps disclose removal of water from a toilet bowl. However, they cannot be operated to remove all of the water in the bowl because there is a mismatch in the shapes of the various inlets with the shape of the bottommost portion of the bowl. Those devices that employ tubing as inlets, moreover, are cumbersome as an extra hand is required to properly position the tubing inlet while, at the same time, operating the pump. The need for a power source and motor is also a disadvantage, as batteries must be replaced and the motors and the impellers driven by the motors may wear out.

SUMMARY OF THE INVENTION

A portable toilet tank and bowl drainage device is disclosed. The device has a housing with an inlet duct disposed therein for positioning relative to a submerged surface and that is configured to receive the liquid above the submerged surface. The exterior of the housing has a plurality of conducting channels disposed thereon to communicate directly with the inlet. . The housing also has an outlet duct spaced from the inlet. The outlet is configured to discharge the liquid received from the inlet duct.

The housing further has an housing opening that is configured to connect to means for creating suction which can include a central tube. A central tube has a first end that is in direct communication with the housing and is preferably sealingly connected to the housing at the housing opening. A second end of the central tube is configured to be in communication with a means to create suction. Preferably, it is sealingly connected to a collapsible bulb or, alternatively, to a collar that connects to the collapsible bulb.

The device further has a collapsible bulb that is sized for grasping with the hand of a user. The bulb has an opening that is sealingly connected to the second end of the central tube or, alternatively, to a collar that connects to the central tube. The bulb is formed of an elastically deformable material that is deformable by the hand of the user between an at-rest position and a compressed position. The bulb has sufficient resilience to return to the at-rest position from the compressed position upon release of the hand of the user. Operation of the bulb from the at rest position to the collapsed position and then back to the at rest position creates a suction and a pumping action.

An inlet check valve is mounted within the housing, and preferably to the inlet duct, to regulate the flow of fluid through the inlet duct. The inlet check valve is operable between an open position and a closed position. An outlet check valve is also mounted within the housing, and preferably to the outlet duct, to regulate the flow of liquid therethrough. The outlet check valve is operable between an open position and a closed position. A discharge tube is connected to the housing to be in fluid communication with the outlet to direct liquid away from the outlet.

The device operates by locating or positioning the inlet surface of the housing adjacent to or on a wetted surface and operating the collapsible bulb repetitively between the at-rest position and the compressed position. Movement of the collapsible bulb from the at-rest position to the compressed position causes the air in the bulb to be exhausted preferably out the discharge. Relaxing the bulb in the compressed position allows it to move toward the at-rest position in turn creating a vacuum and in turn drawing liquids such as water positioned proximate the inlet toward the inlet and through conducting channels toward the inlet. The liquids are thereafter drawn into the device. Subsequent movement of the collapsible bulb from the at-rest position to the compressed position expels water from the device through the outlet. The discharge tube transports liquid from the outlet of the device to a remote location.

DESCRIPTION OF THE ILLUSTRATED EMBODIMENT

Figure 1:
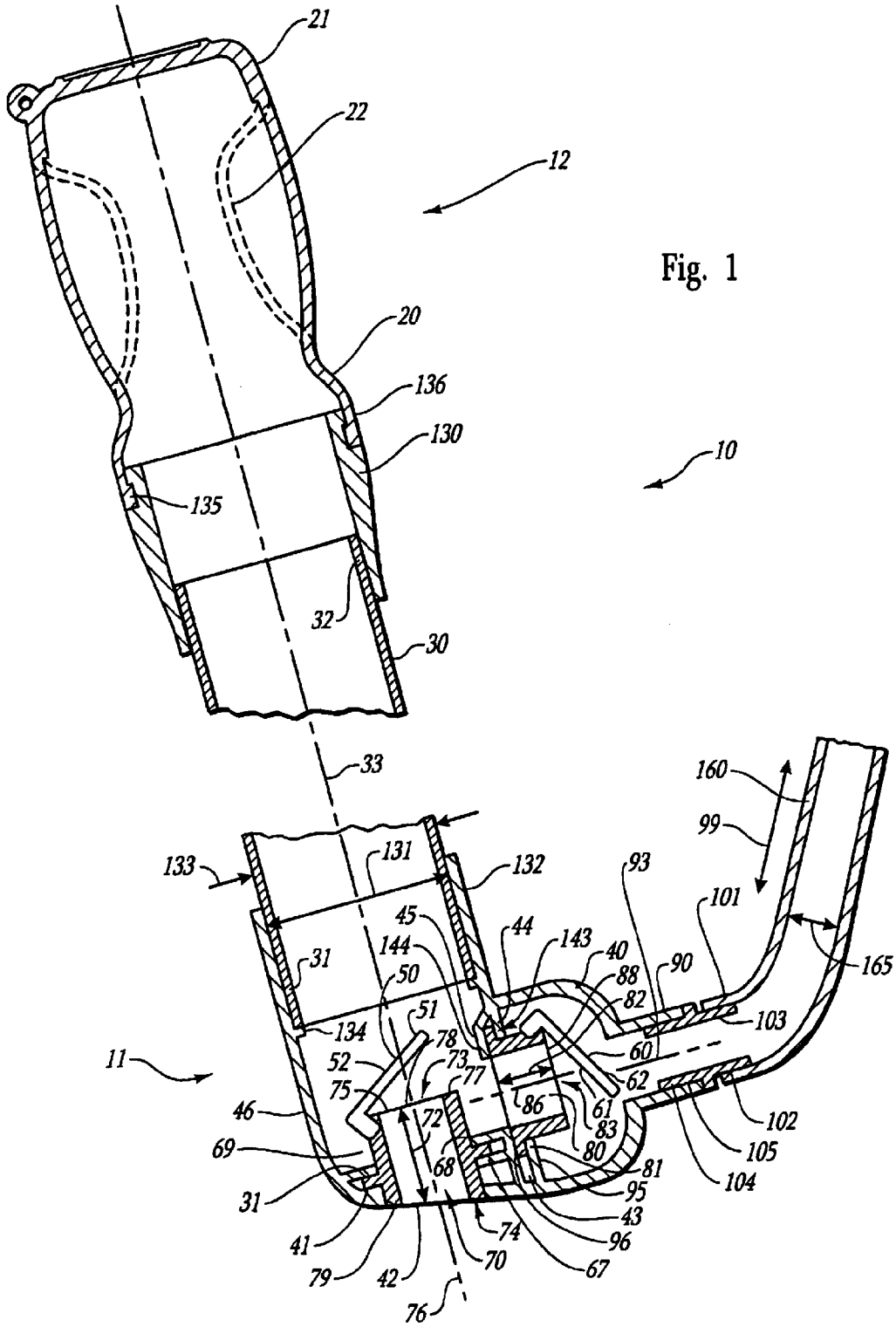
FIG. 1 is a cross sectional partial view of portion of a toilet bowl and tank drainage device of the present invention.

The drawings illustrate a device to evacuate water from the bowl and tank of toilet and tank arrangement and also from other liquid containing receptacles in which there is a liquid above a submerged surface. The device here is referred to as a toilet bowl and tank drainage pump which is generally identified by the reference numeral 10. With reference to FIG. 1, the pump 10 has a manually operable device to create a suction which is here shown as a collapsible bulb 20. The pump 10 also includes a central tube 30 and a valve housing 40. The valve housing 40 has positioned therein an inlet check valve 50 and an outlet check valve 60.

A liquid such as water is drawn into the pump 10 via an inlet duct 70 and is expelled from the pump 10 via an outlet duct 80. A discharge tube 100 is connected to a discharge port 90 that is formed integrally with the valve housing 40 and carries water from the pump 10 to a discharge location. The discharge location may be, for example, the toilet bowl 192 (see FIG. 6) or a bucket when draining the toilet tank 191. Alternatively, the discharge location may be the toilet waste stack 195 or a bucket when draining the toilet bowl 192. When the waste stack 195 is not clogged with waste, water is first drained from the tank 191 into the bowl 192 and then drained from the bowl 192 into the waste stack 195, thereby completely evacuating water from both the toilet tank 191 and bowl 192. The toilet and tank combination may then be removed from their floor seating without spilling any water in the process. Of course if the toilet is in an outdoor climate, removal of the water protects it from breakage by the freezing of the water in the toilet bowl and tank.

Figure 2:
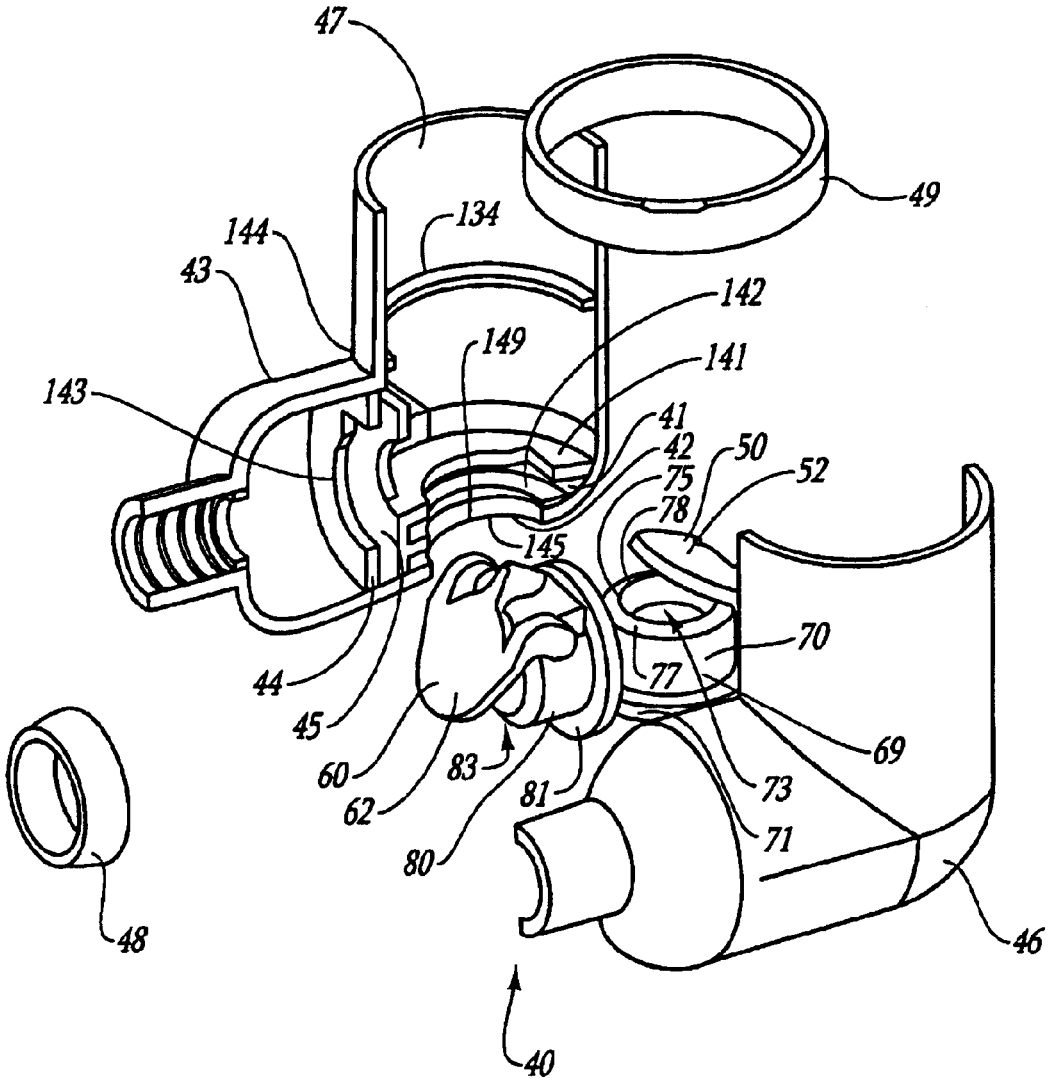
FIG. 2 is a perspective exploded view of a portion of the housing of the toilet bowl and tank drainage device of FIG. 1.
Figure 4:
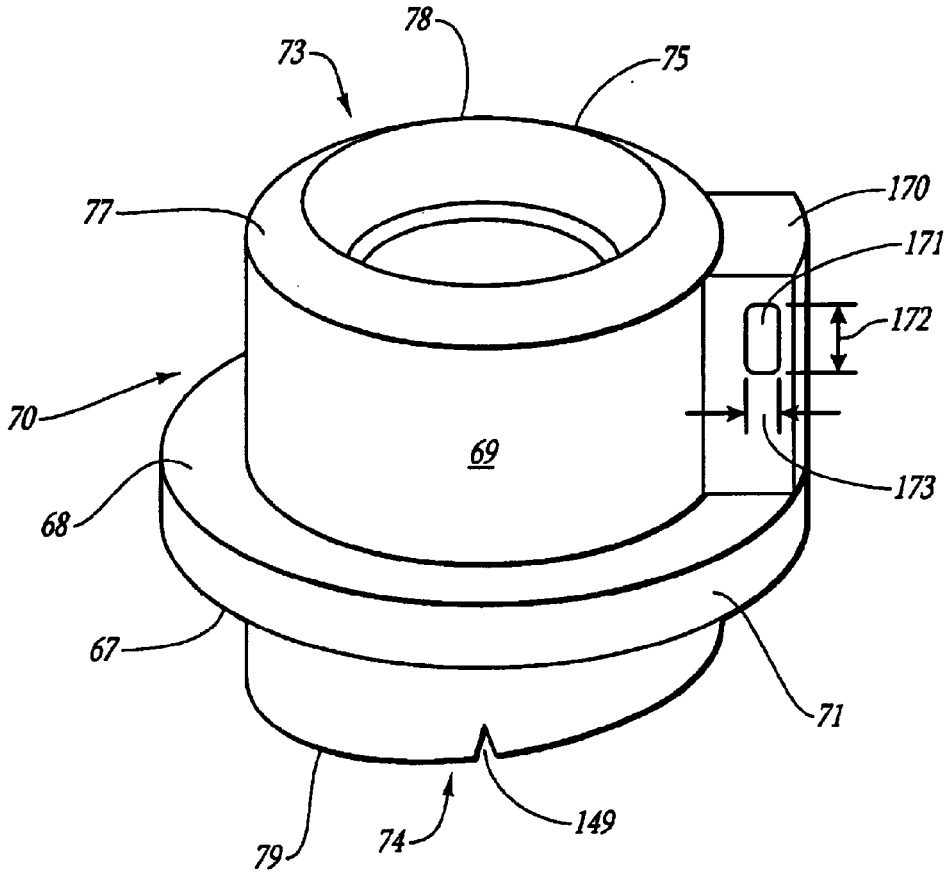
FIG. 4 is a perspective view of the inlet duct of the toilet bowl and tank drainage device of FIG. 1.
Figure 5:
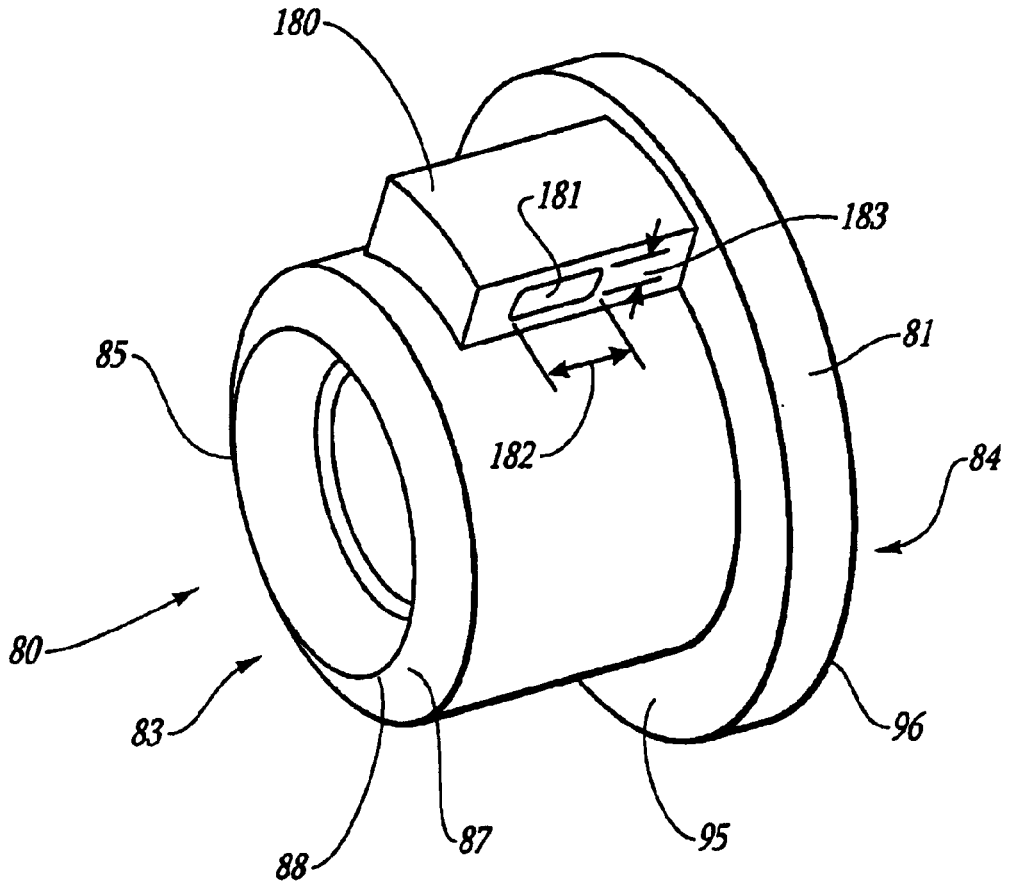
FIG. 5 is a perspective view of the outlet duct of the toilet bowl and tank drainage device of FIG. 1.

Referring, more particularly, to FIGS. 1, 2 and 4 , details of the inlet duct 70 and the outlet duct 80, and their respective inlet check valve 50 and outlet check valve 60, are illustrated. The inlet duct 70 is cylindrical in shape and has an annular ring 71 formed on its exterior surface 69 that is sized to effect a watertight fit when disposed within a similarly sized annular recess 41 formed in the valve housing 40. The watertight fit may be provided using various suitable means, such as, for example, close tolerances between contacting faces 68 and 67 of the ring 71 and recess 41 or by use of glue or cement between the contacting faces 68 and 67 and the faces or surfaces of the recess 41.

The inlet duct 70 has a centerline 33 and an average length 72 here taken along the centerline or axis 76 such that a first end 73 of the inlet duct 70 will extend sufficiently far into the valve housing 40 to enable the inlet check valve 50 to operate between open and closed positions without contact interference from surrounding structure of the housing 40. The inlet duct 70 also has a second end 74 that is positioned proximate an inlet surface 42 of the valve housing 40 when the valve housing 40 is fully assembled.

In one embodiment here illustrated, the inlet duct 70 has a length 72 from about ½ of an inch to about 1 inch, and is preferably about ¾ of an inch. The first end 73 of the inlet duct 70 has a rim 75 that is preferably perpendicular to the axis 76 that extends the length 72 of the inlet duct 70. The axis 76 of the inlet 70 is here shown to be the same as axis 33 of the tube 30.

The rim 75 of the inlet 70 has a beveled surface 77 that terminates in a knife edge 78 against which the inlet check valve 50 may rest to form a water-tight seal. The rim 75 need not be circular as illustrated, but may be of different geometric shape, for example, square or triangular. The rim 75 need not be perpendicular to the axis 76, but may be positioned at an angle to the axis 76. The inlet duct 70 also need not be exactly cylindrical as illustrated but may be curved along a curved axis as well. Further, the inlet duct 70 need not be positioned so that its axis 76 is coaxial with an axis 33 of the central tube 30, but may be positioned so that the axes 76, 33 are at an angle with respect to each other. The second end 74 of the inlet duct 70 has a surface 79 that is configured to form a generally smooth surface with the inlet surface 42 of the housing.

A hinge pin base 170 (see FIG. 6) is formed as part of the inlet duct 70 proximate the first end 73. The hinge pin base 170 has recesses 171 formed on either side of the hinge base 170 to receive the right and left hinge pins 116 and 117 of the inlet check valve 50. The recesses 171 are elongate in shape and have a length 172 and a width 173 that are selected to enable rotational movement of the inlet check valve 50 between its open (spaced away from rim 75) and closed positions (positioned on rim 75) and to reduce the need for dimensional precision in the formation of the inlet check valve 50.

The inlet gate 50 (FIG. 2) has a first face 51 and a second face 52. The first face 51 makes contact with the first end 73 of the inlet duct 70 when the inlet gate 50 is in the closed position. Specifically, the first face 51 is preferably planar or flat and is oriented with respect to the first end 73 such that the first face 51 rests sealingly against the knife edge 78 of the inlet duct 70 when the inlet gate 50 is in the closed position. The sealing relationship between the first face 51 and the knife edge 78 inhibits the flow of liquid such as water through the inlet duct 70 when the collapsible bulb 20 moves from the first, at-rest position 21 to a second, compressed position 22 (discussed below). Conversely, the inlet gate 50 opens under the force of the flow of water or other liquid through the inlet duct 70 when the collapsible bulb 20 moves from a second, compressed position 22 to the first, at-rest position 21. Shapes for the first face 51 other than planar are contemplated, such as, for example, scallop type shapes, so long as the first face fits sealingly with a corresponding shape of the knife edge 78 of the inlet duct 70.

The outlet duct 80 is, like the inlet duct 70, cylindrical in shape and has an annular ring 81 formed on its periphery that is sized to affect a watertight fit when disposed within a similarly sized annular recess 43 formed in the valve housing 40. The watertight fit may be provided using suitable means, such as, for example, close tolerances between contacting faces 95 and 96 of the ring 81 and recess 43 or by use of glue or cement between the contacting faces 95 and 96 and the surfaces of the recess 43.

The outlet duct 80 has an axis 86 with an average length 82 therealong selected so that a first end 83 of the outlet duct 80 will extend a sufficient distance from a first partition wall 44 in the valve housing 40 to enable the outlet gate 60 to operate between open (spaced away from rim 85) and closed positions (seated on rim 85) without contact interference from surrounding structure of the housing 40.

The outlet duct 80 also has a second end 84 that is positioned proximate the partition wall 44 in the valve housing 40 when the valve housing 40 is fully assembled. In practice, the outlet duct 80 has a length 82 from about ¼ of an inch to about 1 inch, and is preferably about ½ of an inch. The first end 83 of the outlet duct 80 has a rim 85 that is preferably perpendicular to axis 86. The rim 85 has a beveled surface 87 that terminates in a knife edge 88 against which the outlet gate 60 may rest and form a seal. It is realized that the rim 85 need not be circular as illustrated, but may be in other geometric shapes , for example, square or triangular. The rim 85 need not be perpendicular to the axis 86, but may be positioned at an angle to the axis 86. The outlet duct 80 need not be exactly cylindrical as illustrated, but may be curved along a curved axis as well. Further, the outlet duct 80 need not be positioned so that its axis 86 is coaxial with an axis 93 of the discharge port 90, but can be positioned so that the axes 86, 93 are at an angle with respect to each other.

The second end 84 of the outlet duct 80 has a surface 89 that is flat and configured to form a water-tight seal when engaged between the first partition wall 44 and a second partition wall 45. The watertight seal may be obtained using the techniques described above, that is, with close tolerances or with glue or cement.

A hinge pin base 180 (see FIG. 7) is formed as part of the outlet duct 80 proximate the first end 83. The hinge pin base 180 has recesses 181 formed on either side of the hinge base 180 to receive hinge pins of the outlet gate 60 like hinge pins 116 and 117 . . . The recesses 181 are elongate in shape and have a length 182 and a width 183 that are selected to enable rotational movement of the outlet gate 60 between its open and closed positions and to reduce the need for dimensional precision in the formation of the outlet gate 60.

The outlet gate 60 has a first face 61 and a second face 62. The first face 61 makes contact with the first end 83 of the outlet duct 80 when the outlet gate 60 is in the closed position. Specifically, the first face 61 is preferably planar in shape and is oriented with respect to the first end 83 such that the planar surface of the first face 61 rests sealingly against the knife edge 88 of the outlet duct 80 when the outlet gate 60 is in the closed position. The seal ring relationship between the first face 61 and the knife edge 88 inhibits the flow of water or other liquid through the outlet duct 80 and into the tube 30 when the collapsible bulb 20 moves from a second, compressed position 22 to the first, at-rest position 21 (discussed below). Conversely, the outlet gate 60 opens against the flow of water or other fluids including liquids through the outlet duct 80 when the collapsible bulb 20 moves from the first, at-rest position 21 to a second, compressed position 22. Shapes for the first face 61 other than planar are contemplated, such as, for example, scallop type shapes, so long as the first face 61 fits sealingly with a corresponding shape of the knife edge 88 of the outlet duct 80.

Figure 3:
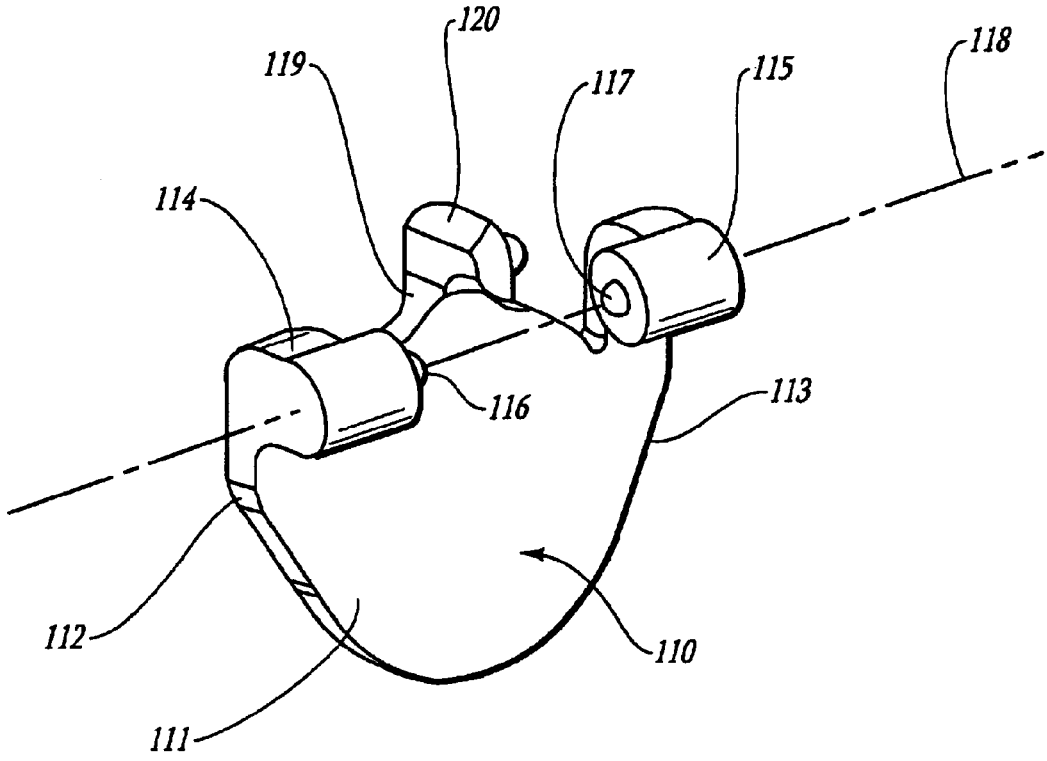
FIG. 3 is a perspective view of an inlet or outlet valve disc or flapper of the toilet bowl and tank drainage device of FIG. 1.

Referring to FIG. 3, an exemplary embodiment of a gate 110, useful for both the inlet gate 50 and the outlet gate 60, is illustrated. That is, the same sized gate may be used for both the inlet gate 50 and the outlet gate 60. Specifically, the gate 110 has a flat surface 111 for contact with a corresponding sealing surface, such as the knife edge 78 of the inlet duct 70 or the knife edge 88 of the outlet duct 80. The surface adjacent the flat surface 111, such as, for example, second face 52 and second face 62, need not be flat but, if desired, may be curved to enhance strength or operational performance.

The gate 110 further includes a left arm 112 and a right arm 113. The left arm 112 and the right arm 113 have, respectively, a left shoulder 114 and a right shoulder 115. The left shoulder 114 and the right shoulder 115 are formed to have a left hinge pin 116 and a right hinge pin 117, respectively.

The left and right hinge pins 116, 117 are disposed on an axis 118 and are configured to engage the recesses 171, 181 that are disposed on either side of the hinge pin bases 170, 180. The length and diameter of the hinge pins 116, 117 are selected to cooperate with the lengths 172, 182 and widths 173, 183 of the recesses 171, 181.

As discussed previously, the recesses 171, 181 are elongate in shape. The elongate shape reduces the need for dimensional precision in manufacturing the gate 110 and permits the gate 110 (or, more specifically, the inlet gate 50 and outlet gate 60) to move axially along the inlet duct 70 or the outlet duct 80 so as to reduce the possibility of valve jamming or of a small piece of debris becoming trapped between the knife edge of the inlet 70 or outlet duct 80 and the first face 51 and 61 of the inlet or outlet gates 50 and 60, respectively.

The gate 110 is, preferably, unitarily formed out of a suitable plastic so that the left and right arms 112 and 113 may elastically flex sufficiently so that the hinge pins 116 and 117 may be snapped into their respective recesses of the hinge pin bases 170 and 180, but not so tightly so as to prevent rotation of the gate 110 between open and closed positions. The gate 110 also includes a stop arm 119 that is configured to extend from the surface opposite surface 111. The stop arm 119 has a stop member 120 positioned at the distal end of the stop arm 119. The stop member 120 is positioned and configured to make contact with the hinge pin bases 170 and 180 with the inlet gate 50 or the outlet gate 60 in the open position and so that the flow of fluid toward the respective inlet 70 and outlet 80 will urge the gates 50 and 60 toward the closed positioned. Preferably, the gate 110 is constructed of a material having a specific gravity greater than that of the liquid or fluid such as water. Use of such materials prevent the gate 110 from floating to toward the open position when such is not desired and eliminates the need for springs or other structure to urge the gate and more specifically the flat surface 111 against the knife edges 78 and 88 of the inlet duct 50 and outlet duct 60. Use of such materials permit the gate 110 to close less slowly than would be the case with spring loaded valves, such that a small amount of water is permitted to back-flush against the knife edges 78 and 88 before the gates 50 and 60 completely close, thereby urging away any debris that may have come to rest on the knife edges 78 and 88 during operation of the bulb 20. The 110 is made of material having a specific gravity from about 1.1 to about 1.5. A specific gravity of about 1.2 has been found suitable for these purposes.

Referring now to FIG. 2, the valve housing 40 is illustrated to have a first section 46 and a second section 47. The first and second sections 46, 47 have formed therein, and integrally therewith, the annular recess 41 that engages the annular ring 71 of the inlet duct 70 and the annular recess 43 that engages the annular ring 81 of the outlet duct 80. For example, the annular recess 41 that engages the annular ring 71 of the inlet duct 70 has first and second wall pieces 141, 142 that are configured to sealingly engage the annular ring 71, thereby forming a water-tight fit. Similarly, the annular recess 43 that engages the annular ring 81 of the outlet duct 80 has first and second wall pieces 143, 144 that are configured to sealingly engage the annular ring 81, thereby forming a water-tight fit. It is noted that the first and second wall pieces 143, 144 also form the first wall partition 44 and the second wall partition 45 referred to above. The first and second sections 46, 47 are formed to provide a water and air tight fit when fastened together. The first and second sections 46, 47 may be fastened together by sliding tight fitting rings 48, 49 over the periphery of the housing opening and discharge duct of the housing or, alternatively, by simply gluing the sections together.

The first section 46 and second section 47 also have inlet surface portions 145 and 146, respectively, that define the geometry of the inlet surface 42. The inlet surface portions 145 and 146 are configured such that the inlet surface 42 has a generally flat surface that is shaped to engage the surfaces 193, 194 that are found in the tank 191 and bowl 192 of a standard toilet assembly 190. The valve housing 40 has an upright portion 40A and a transverse portion 408 that is transverse to the upright portion 40A as shown in FIGS. 1, 2 and 7A. FIG. 7A is a cross section of the housing 40 perpendicular to axis 93 along axis 76. The transverse portion 40B is seen with a bottom 40C that is arcuate in cross section. The outer portions 40F are shown to be circular in cross section with a first radius 40D. The outer portions 40F transition to another arcuate surface 40G, which is also circular in cross section, having a radius 40E that is larger than radius 40D. The arcuate surface 40G transitions to the flat portion of the inlet duct 70 which defines the inner flat portion 40H of inlet surface 42 under the upright portion 40A. The phrase "generally flat," is here meant to include embodiments where the inlet surface portions 145, 146 of the valve housing 40 are configured to provide a small degree of curvature for the inlet surface 42. A small degree of curvature for the inlet surface 42 enables the pump to better affect the suction of water off from those surfaces that are not, in fact, perfectly flat, but that exhibit a small degree of curvature themselves, say, for example, on the order of about 3 to about 12 inches in radius. A small degree of curvature for the inlet surface 42 does not, however, hinder suction of water off from surfaces that exhibit infinite curvature, that is, surfaces that are perfectly flat. Similarly, a perfectly flat inlet surface 42 does not appreciably hinder the suction of water off from surfaces that exhibit a small degree of curvature. Regardless of the curvature selected for the inlet surface 42, the second end 74 of the inlet duct 70 should be contoured to provide a smooth transition between the second end 74 and the inlet surface portions 145 and 146 of the valve housing.

Figure 7:
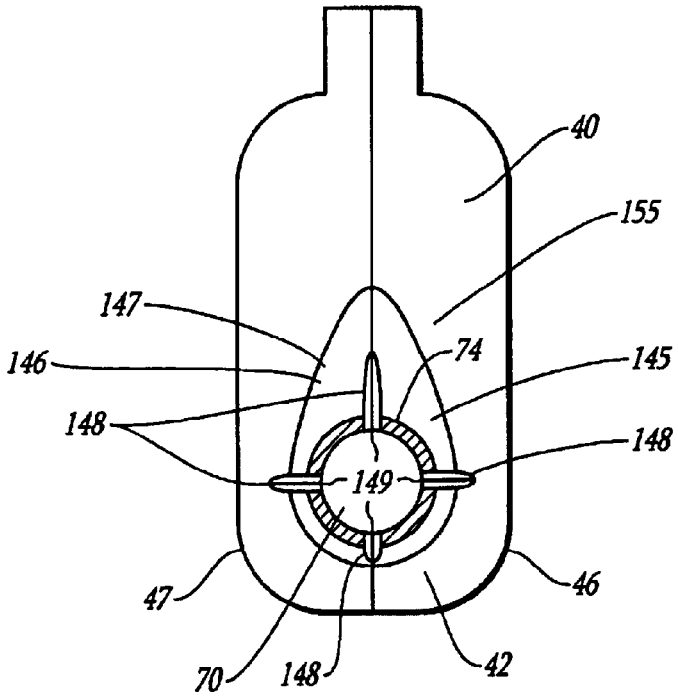
FIG. 7 depicts the underside view of the housing of the toilet bowl and tank drainage device of FIG. 1.
Figure 7A:
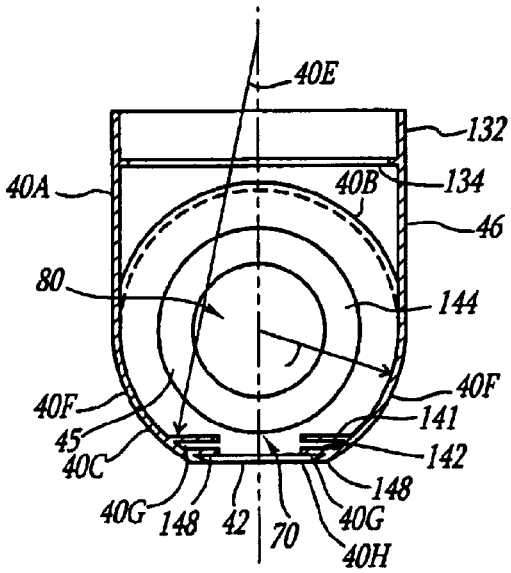
FIG. 7A is a simplified depiction of a cross section of the housing taken looking the outlet.

Referring to FIG. 7, the undersurface 155 of the valve housing 40 is illustrated as having a flat inlet surface 147. Grooves 148 are formed and in the valve housing 40 and conducting channels 149 are formed in the inlet duct 70 in communication with the grooves 148. With the inlet surface 147 positioned on the surface under the liquid like the bottom 194. The grooves 148 and conducting channels 149 enable liquid to proceed toward the inlet duct 70. That is, the small amounts of water that otherwise might remain in the tank or bowl can be removed. Stated otherwise, the flat inlet surface 147 may be placed directly on the tank surface 193 or the bowl surface 194. Thereafter, the pump like the bulb 20 may be operated to entrain liquid such as water that remains in shallow pockets on the surfaces 193, 194. In effect, the liquid such as water is entrained or mixed with air as it moves into the inlet duct 70 from the grooves 148 and conducting channels 149 and into the central tube 30.

The depth of the grooves 148 and the conducting channels 149 is from about 0.5 to about 2 millimeters, and preferably about 1 millimeter, below the flat inlet surface 147. For the case of a generally flat surface like surface 194 as opposed to a flat surface like surface 193, the grooves 148 and the conducting channels 149 will follow the slightly curved contour of the generally flat surface.

Figure 6:
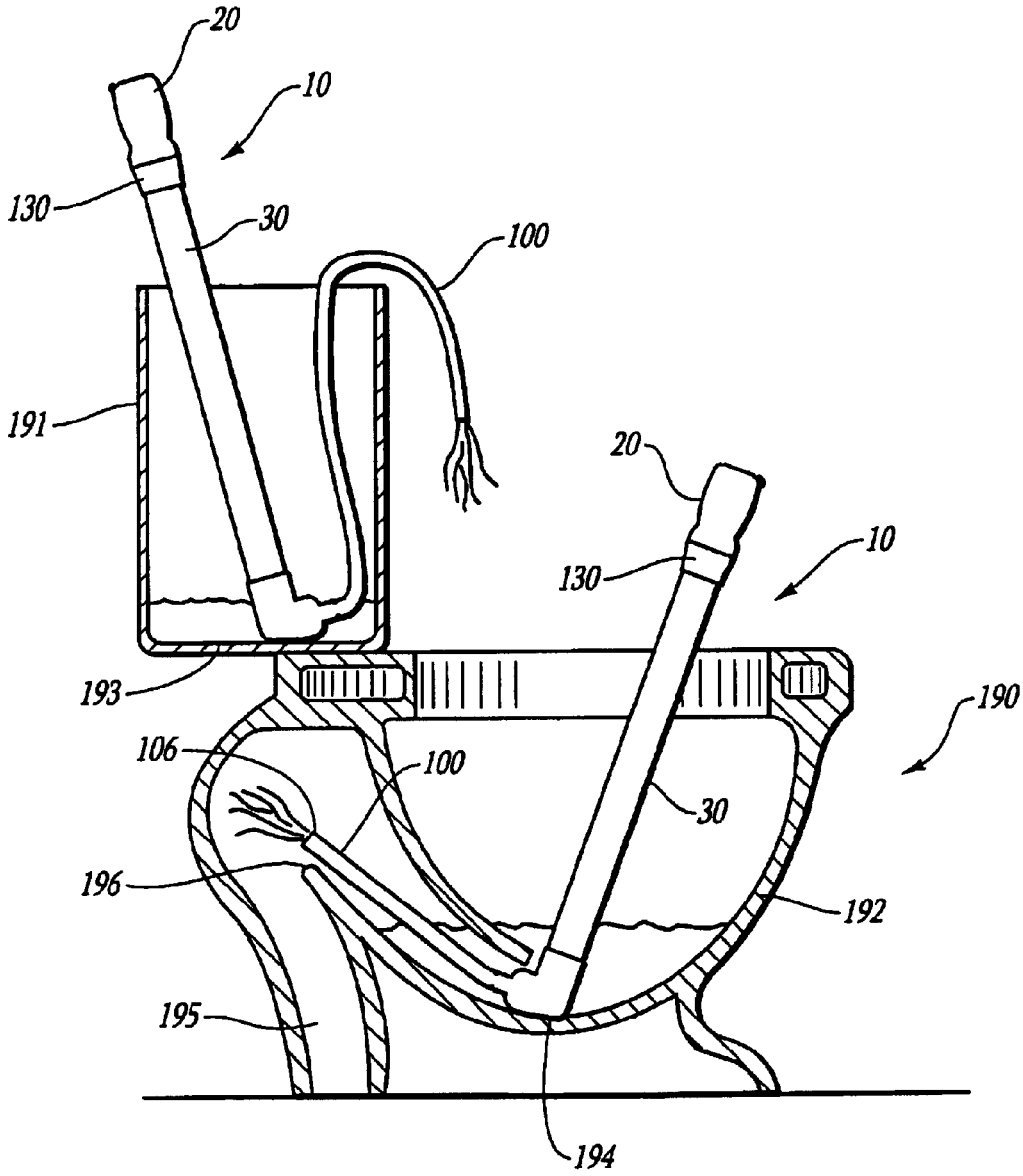
FIG. 6 is a cross sectional depiction the toilet bowl and tank drainage device positioned to drain tank and to drain a bowl of the toilet bowl and tank.
Figure 9:
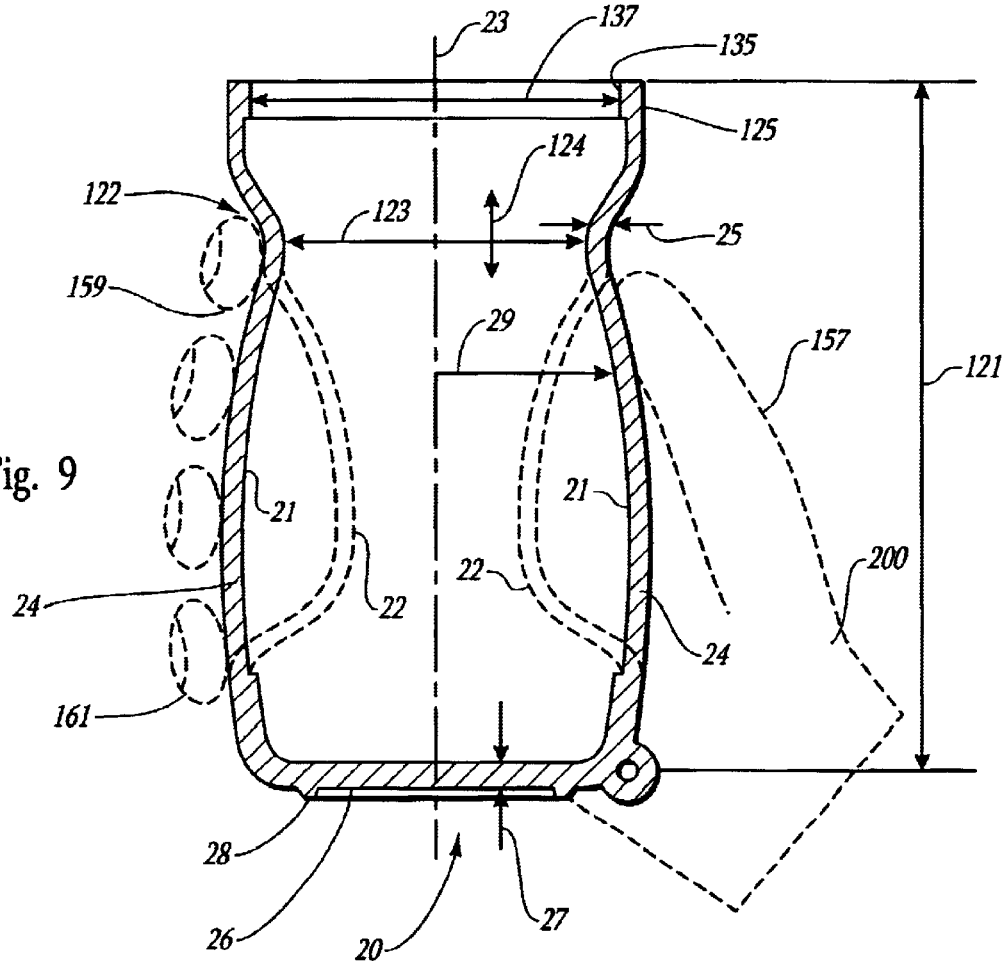
FIG. 9 is a cross sectional view of a collapsible bulb of the toilet bowl and tank drainage device of FIG. 1.

Referring now to FIGS. 1, 6 and 9, the manually operable device to create a suction is a collapsible bulb 20 which is illustrated as being in communication with the valve housing 40 via a central tube 30. The collapsible bulb 20 is made of a rubber-like material that may, in fact, be rubber or any material with similar characteristics. Specifically, the material of the collapsible bulb 20 is selected to be deformable by manipulation with the human hand. A collapsible bulb 20 made from material with a durometer from about 20 to about 80, and preferably about 50. The collapsible bulb 20 is preferably formed to have a circular cross section, but with a variable diameter along its central axis 23. The side wall 24 of the bulb 20 has a wall thickness 25 selected so that the bulb 20 may be readily and repetitively squeezed by the human hand to effect a pumping action as discussed herein below. The wall thickness 25 may range from about 1/64 of an inch to about 1/4 of an inch and, preferably, is about 1/8 of an inch when the material has a durometer of about 50. The collapsible bulb 20 has, further, a rear wall 26 that is formed to be generally transverse to the central axis 23. The rear wall 26 is unitarily formed with the side wall 24, but with a wall thickness 27 that is greater than the wall thickness 25 of the side wall 24. A circular ridge 28 provides stability to the rear wall 26. The rear wall 26 has, preferably, a wall thickness 27 of about 1/4 of an inch.

Referring specifically to FIG. 9, the collapsible bulb 20 has a variable diameter 29 along its overall length 121. A necking portion 122 has a diameter 123 and a length 124 that are sized to accept the thumb 157 and forefinger 159 of a user's hand 200 (illustrated in phantom). The overall length 121, moreover, is sized to accept all the fingers 161 of the user's hand 200. In practice, the bulb 20 has a diameter 29 that is about 2 and 3/8 inches at its greatest point and a diameter 123 that is about 1 and 3/4 inches at the necking portion 122. The overall length 121 of the collapsible bulb 20 is about 4 and 5/8 inches long and is selected so that an overlapping portion 125 extends forward of the necking portion 122 for connection to a bulb collar 130 and for further connection to the central tube 30.

With the bulb 20 formed, sized and shaped as described, the user's hand 200 (both male and female) can manipulate the bulb 20 between a first, at-rest position 21 and a second, compressed position 22. Specifically, when the side wall 24 is manipulated inward toward the central axis 23, the volume of the bulb 20 changes from about 400 milliliters at the first, at-rest position 21 to about 200 milliliters at the second, fully compressed position 22. With a side wall thickness 25 of about 1/8 of an inch and a rear wall thickness 27 of about 1/4 of inch, and with the material of the bulb 20 having a durometer of about 50, a collapsible bulb 20 having the dimensions above discussed so as to provide an at-rest volume of about 400 milliliters, can produce a vacuum of about 45 inches of water as the bulb moves from its second, fully compressed position 22 to its first, at-rest position 21. The material properties disclosed and described herein enable the bulb 20 to automatically return to its at-rest position 21, from the compressed position 22, upon release of the hand of the user and, when doing so, draw liquid such as water in through the inlet of the housing 40 and into the central tube 30.

Referring now to FIGS. 1, 6, 8 and 9, a central tube 30 is disposed between the collapsible bulb 20 and the valve housing 40. Specifically, the central tube 30 has a first end 31 that is connected to the valve housing 40 and a second end 32 that is connected to the bulb collar 130. The bulb collar 130 is itself connected to the collapsible bulb 20. The first end 31 of the central tube 30 is snugly connected to the valve housing 40 by selecting the outer diameter 133 of the tube 30 to be essentially the same as the inner diameter 131 of the top portion 132 of the valve housing 40. A snug fit made in this fashion permits disassembly of the valve housing 40 from the central tube 30. Alternatively, a layer of plastic cement may be applied to permanently seal and affix the valve housing 40 to the central tube 30.

An annular lip 134 is formed into the valve housing 40 and serves to provide a stop for the central tube 30. The second end 32 is connected to the bulb collar 130 in the same fashion as the first end 31 is connected to the valve housing 40. The central tube may range in length from about 12 inches to about 48 inches and, preferably, is about 15 inches. The outer diameter 133 of the central tube 30 is preferably about 1 and 1/4 inches, but may range from about 1/2 of an inch to about 2 inches. Likewise, the inner diameter 131 of the top portion 132 of the valve housing is preferably about 1 and ¼ inches. Similar dimensions are employed at the second end 32 of the central tube 30 and the engaging portion 140 of the bulb collar 130. Specifically, the bulb collar 130, preferably, has an inner diameter 134 of about 1 and ¼ of an inch, which is identical to the preferred outer diameter of the central tube 30. The illustrated tube 30 is shown as a straight tube with a central straight axis 33. Central tubes that are curved along their lengths may be used, as opposed to straight tubes.

Figure 8:
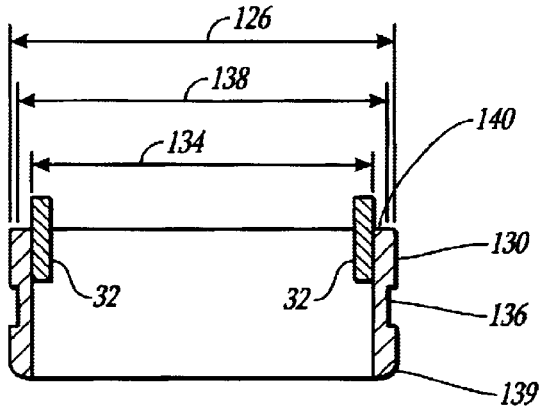
FIG. 8 is a cross sectional view of a bulb collar of the toilet bowl and tank drainage device of FIG. 1.

Referring now to FIGS. 1, 8 and 9, the collapsible bulb 20 is connected to the bulb collar 130 by snugly engaging an annular lip 135 that is formed integrally with the collapsible bulb 20 with an annular recess 136 that is formed in the bulb collar 130. The inside diameter 137 of the annular lip 136 is less than the outside diameter 138 of the bulb collar 130. This forces the bulb 20 to be elastically stretched or deformed when the annular lip 135 is engaged with the annular recess 136, thereby ensuring an air and water tight connection between the bulb 20 and the collar 130.

The bulb collar 130 has a beveled edge 139 to facilitate placement of the annular lip 135 into the annular recess 136. The outside diameter 126 of the bulb collar 130, proximate the engaging portion 140, is selected to act as a stop for the collar 130 and collapsible bulb 20 once the annular lip 135 is engaged with and into the annular recess 136.

The connections between the bulb 20 and the collar 130, between the collar 130 and the tube 30 and also between the central tube 30 and the housing 40 are snug to be essentially water tight and air tight. Glue, plastic cement and snug fit tolerances or other suitable means are used to effect the desired air and water-tight seals.

Referring now to FIGS. 1 and 6, a discharge tube 100 is connected to the discharge port 90 of the valve housing. The discharge tube 100 has a length 99 that is preferably from about 6 inches to about 24 inches and is preferably about 9 inches. The inside diameter 165 of the discharge tube 100 is preferably about ⅜ of an inch, but may range from about ¼ of an inch to about ½ of an inch. The discharge tube 100 has a proximal end 101 that is connected to the outside portion 103 of a threaded connector 102. The threaded connector 102 has an inside portion 104 that is threadedly connected to the inside diameter 105 of the discharge port 90. The threaded connector 102 facilitates rapid substitution of discharge tubes 100 having varying lengths.

Referring specifically to FIG. 6, operation of the toilet tank and bowl pump 10 is illustrated. The user or operator may shut off the water source to the toilet and then flush the toilet. The preliminary steps evacuate the bulk of the water from the tank 191 and bowl 192, leaving the residual water that remains for clean-up using the toilet tank and bowl drainage pump 10. In FIG. 6, the levels of water in the tank 191 and in the bowl 192 are illustrative of a toilet after it is flushed. It should be appreciated that the toilet tank and bowl drainage pump 10 may be used regardless of the level of water in the tank 191 and bowl 192.

Next, the user places the lower portion 11 of the pump 10 into the tank 191 of the toilet 190. The distal end 106 of the discharge tube 100 is then extended toward the bowl 192 of the toilet 190. The collapsible bulb 20 is squeezed by the hand 200 from the first, at-rest position 21 to the second, compressed position 22, and then released. The elasticity and resilience of the bulb 20 causes the bulb to return to its first, at-rest position 21. In moving back to the at rest position 21, a vacuum or suction is created in the central tube 30. The vacuum in the central tube 30 causes liquid such as water to be drawn in through the inlet duct 70 and, further, causes the outlet gate 60 to remain in its closed position. Once the collapsible bulb 20 has returned to its first, at-rest position, a column of liquid such as water resides in the central tube 30. The inlet gate 50 will move toward its closed position. At the same time, the pressure of the column of water will force the outlet gate 60 into toward its open position, thereby allowing some of the water in the central tube 30 to flow through the outlet duct 80 into the discharge tube 100. The water will stop flowing through the outlet duct 80 when the level of the water in the discharge tube is the same as the level of water in the central tube 30.

The process is then repeated by squeezing the bulb 20 to its second, compressed position 22 and then allowing the bulb 20 to return to its first, at-rest position 21. As the bulb 20 is squeezed, water remaining in the central tube 30 from the previous cycle will be forced through the outlet duct 80 and into the discharge tube 100. As the bulb 20 returns to its first, at-rest position 21, another column of liquid such as water is drawn into the central tube 30. In the interim, the gate 61 will move toward the outlet 80. The surface elevation of the liquid or water in the discharge tube 100 may be higher than the surface elevation of the liquid or water in the central tube 30 to assist in urging the outlet gate 60 toward the closed position. The process is repeated until the volume of water in the tank 193 is completely evacuated into the bowl 192.

The next step is to place the lower end 11 of the pump 10 into the bowl 192 and to thread the distal end 106 of the discharge tube 100 toward the waste stack 195 of the toilet 190. Because the pump 10 does not depend on a siphon action for use, it is not required that the distal end of the discharge tube 100 be threaded completely into the waste stack. Rather, the distal end 106 need be extended only so far into the waste stack 195 such that the liquid such as water may be pumped over the rim 196 of the waste stack 195. The above described process is then repeated until the water in the bowl 192 has been completely evacuated into the waste stack 195 of the toilet 190.

The above described process may be modified, if needed or if otherwise convenient, through use of varying lengths of the discharge tube 100. For example, longer or shorter lengths of discharge tube 100 may be used during the tank drainage process and the bowl drainage process, for as illustrated in FIG. 6, a longer discharge tube 100 may be required to carry water over the rim of the toilet tank. Different lengths of discharge tube 100 may also be used depending on the dimensions of the particular toilet being drained—that is, longer or shorter lengths 99 of discharge tube 100 may be used to coincide with larger or smaller toilets.

A toilet tank and bowl drainage device such as pump 10 has been described with reference to particular embodiments in the foregoing description. Various other modes for carrying out the invention are, however, contemplated as being within the scope of the claims that follow and that particularly point out and distinctly claim the subject matter which is regarded as the invention.

What is claimed:

1. A portable pump for removing liquid from the flat bottom surface of a toilet tank and the arcuate bottom surface of a toilet bowl, said portable pump comprising:

a housing having a first end for positioning on the flat bottom surface of said toilet tank and the arcuate bottom surface of said toilet bowl, both of said bottom surfaces having liquid positioned thereon, said housing having a second end spaced from said first end, said housing having an inlet formed in said first end configured to receive said liquid positioned on said bottom surface of said toiled tank and on said bottom surface of said bowl and said housing having an outlet configured to discharge said liquid received into said housing from said inlet, said first end having an arcuate portion shaped to substantially conform to said arcuate bottom surface of said toilet bowl and contact said arcuate bottom surface during pump operation and said first end further having a flat portion shaped to substantially conform to said flat bottom surface of said toilet tank and contact said flat bottom surface during pump operation, said arcuate portion located on the periphery of said flat surface and said flat bottom surface having said inlet disposed therein;

a hand pumping device connected to be in communication with said housing, said hand pumping device being operable by a user to urge said liquid into and out of said housing;

an inlet gate mounted within said housing and proximate said inlet, said inlet gate being operable between an open position to allow liquid to flow into said housing from said inlet and a closed position to inhibit the flow of liquid out of said inlet;

an outlet gate mounted within said housing and proximate said outlet, said outlet gate being operable between an open position to allow liquid to out from said housing and a closed position to inhibit the flow of liquid and air into said housing; and a discharge tube having a first tube end connected to said outlet and a second tube end spaced away from said housing and positioned to discharge said liquid away from said toilet tank and said toilet bowl.

2. A portable pump for removing liquid from the flat bottom surface of a toilet tank and the arcuate bottom surface of a toilet bowl, said portable pump comprising:

a housing having a first end for positioning on the flat bottom surface of a said toilet tank and the arcuate bottom surface of a said toilet bowl, both of said bottom surfaces having liquid positioned thereon, said housing having a second end spaced from said first end, said housing having an inlet formed in said first end configured to receive said liquid positioned on said bottom surface of said toiled tank and on said bottom surface of said bowl and said housing having an outlet configured to discharge said liquid received into said housing from said inlet, said first end having an arcuate portion shaped to substantially conform to said arcuate bottom surface of said toilet bowl and contact said arcuate bottom surface during pump operation and said first end further having a flat portion shaped to substantially conform to said flat bottom surface of said toilet tank and contact said flat bottom surface during pump operation, said arcuate portion located on the periphery of said flat surface, said first end having liquid conducting channels formed therein for directing liquids toward said inlet when said inlet gate is open and said hand pumping device is operated to draw liquid into said inlet;

a hand pumping device connected to be in communication with said housing, said hand pumping device being operable by a user to urge said liquid into and out of said housing;

an inlet gate mounted within said housing and proximate said inlet, said inlet gate being operable between an open position to allow liquid to flow into said housing from said inlet and a closed position to inhibit the flow of liquid out of said inlet;

an outlet gate mounted within said housing and proximate said outlet, said outlet gate being operable between an open position to allow liquid to out from said housing and a closed position to inhibit the flow of liquid and air into said housing; and a discharge tube having a first tube end connected to said outlet and a second tube end spaced away from said housing and positioned to discharge said liquid away from said toilet tank and said toilet bowl.

3. The portable pump of claim 2 wherein said first end has said flat portion positioned within said arcuate portion.

4. The portable pump of claim 3 wherein said inlet is formed in said flat portion.

5. The portable pump of claim 2, wherein a fluid path is formed between the liquid conducting channels and one of said flat bottom surface of a toilet tank and said arcuate bottom surface of a toilet bowl during pump operation.

6. The portable pump of claim 1 wherein said inlet gate is formed of a material that has a specific gravity greater than the specific gravity of water, said material being selected to have a specific gravity so it moves from said open position toward said closed position at a rate to allow liquid in said housing to exit said inlet and in turn flush said inlet as said inlet gate attains the closed position.

7. The portable pump of claim 6 wherein said inlet gate and said outlet gate each have a stop member associated therewith to inhibit movement toward said open position and position said inlet gate and said outlet gate in the stream of liquid to pass through said inlet and outlet respectively to be urged toward the closed position upon operation of said hand pumping device.

8. A method of removing liquid from one of a toilet tank having a flat bottom surface and a toilet bowl having an arcuate bottom surface, said method comprising:

providing a pump for removing liquid from said toilet bowl, said pump including, a housing having a first end for positioning on the flat bottom surface of a toilet tank and the arcuate bottom surface of a toilet bowl having liquid positioned thereon, said housing having a second end spaced from said first end, said housing having an inlet formed in said first end configured to receive said liquid positioned on said bottom surface of said toiled toilet tank and said bottom surface of said toilet bowl and said housing having an outlet configured to discharge said liquid received into said housing from said inlet, said first end having a flat portion shaped to substantially conform to said flat bottom surface of said toilet tank and contact said flat bottom surface during pump operation and an arcuate portion shaped to substantially conform to said arcuate bottom surface of said toilet bowl and contact said flat bottom surface during pump operation, said arcuate surface located on the periphery of said flat surface and said flat surface having said inlet disposed therein, a hand pumping device connected to be in communication with said housing, said hand pumping device being operable by a user to urge said liquid into and out of said housing, an inlet gate mounted within said housing and proximate said inlet, said inlet gate being operable between an open position to allow liquid to flow into said housing from said inlet and a closed position to inhibit the flow of liquid out of said inlet, an outlet gate mounted within said housing and proximate said outlet, said outlet gate being operable between an open position to allow liquid to out from said housing and a closed position to inhibit the flow of liquid and air into said housing, and a discharge tube having a first end connected to said outlet and a second end spaced away from said housing and positioned to discharge said liquid away from said toilet bowl;

positioning one of said arcuate portion of said first end to be in contact with said arcuate bottom surface of said toilet bowl and said flat portion of said first end to be in contact with said flat bottom surface of said toilet tank;

operating said hand pumping device to urge liquid from one of said toilet tank bottom surface and said flat bottom surface of said toilet tank into said housing; and operating said hand pumping device to urge liquid from said outing out of said outlet into said discharge tube.

9. A portable pump for removing liquid from the flat bottom surface of a toilet tank and the arcuate bottom surface of a toilet bowl, said portable pump comprising:

a housing having a first end for positioning on the bottom surface of a toilet tank and the arcuate bottom surface of a toilet bowl, said housing having a second end spaced from said first end, said housing at said first end having an upright portion and a transverse portion formed to be transverse to said upright portion when in use, said housing having an inlet formed in said transverse portion configured to receive any liquid positioned on said flat bottom surface of said toilet tank and from said arcuate bottom surface of said bowl when said housing is positioned thereon, and said housing having an outlet in said transverse portion configured to discharge said liquid received into said housing from said inlet, said transverse portion having a circular cross section, said cross-section having a predominant first arcuate surface having a first radius substantially forming a cylinder, a second arcuate surface having a second radius forming an arcuate surface to substantially conform to said arcuate bottom surface of said toilet bowl, and a substantially flat inlet surface formed to substantially conform to said flat surface of said toilet tank, wherein the second arcuate surface is adjacent to the flat inlet surface so that in operation said inlet surface contacts said flat bottom surface or said second arcuate surface contacts said arcuate bottom surface such that water thereon can be withdrawn into said inlet;

a hand pumping device connected to be in communication with said housing, said hand pumping device being operable by a user to urge said liquid into and out of said housing;

an inlet gate mounted within said housing and proximate said inlet, said inlet gate being operable between an open position to allow liquid to flow into said housing from said inlet and a closed position to inhibit the flow of liquid out of said inlet;

an outlet gate mounted within said housing and proximate said outlet, said outlet gate being operable between an open position to allow liquid to out from said housing and a closed position to inhibit the flow of liquid and air into said housing; and a discharge tube having a first end connected to said outlet and a second end spaced away from said housing and positioned to discharge said liquid away from said toilet tank and said toilet bowl.

10. The portable pump of claim 9 wherein said inlet surface includes liquid conducting channels formed therein for directing liquids toward said inlet when said inlet gate is open and said hand pumping device is operated to draw liquid into said inlet, wherein a fluid path is formed between the liquid conducting channels and either the flat bottom surface of a toilet tank or the arcuate bottom surface of a toilet bowl.

11. The portable pump of claim 10 wherein said second radius is larger than said first radius.

12. The portable pump of claim 11 wherein said second radius is from about three inches to about twelve inches.

13. The portable pump of claim 9 further including a flat surface formed in said inlet surface and wherein said inlet is formed in said flat surface.

* * * * *